US008881943B2

(12) United States Patent
Kobayashi

(10) Patent No.: US 8,881,943 B2
(45) Date of Patent: Nov. 11, 2014

(54) TISSUE PAPER SUPPLY CASE

(75) Inventor: Isao Kobayashi, Tokyo (JP)

(73) Assignees: Evermate Co., Ltd., Tokyo (JP); Isao Kobayashi, Tokyo (JP)

( * ) Notice: Subject to any disclaimer, the term of this patent is extended or adjusted under 35 U.S.C. 154(b) by 151 days.

(21) Appl. No.: 13/581,404

(22) PCT Filed: Mar. 7, 2011

(86) PCT No.: PCT/JP2011/055241

§ 371 (c)(1),
(2), (4) Date: Aug. 27, 2012

(87) PCT Pub. No.: WO2011/114927

PCT Pub. Date: Sep. 22, 2011

(65) Prior Publication Data

US 2012/0318818 A1 Dec. 20, 2012

(30) Foreign Application Priority Data

Mar. 17, 2010 (JP) ..... 2010-61555

(51) Int. Cl.
*A47K 10/24* (2006.01)
*B65H 1/00* (2006.01)
*B65H 1/08* (2006.01)

(52) U.S. Cl.
USPC ..... 221/52; 221/56; 221/33; 221/36; 221/39; 221/40; 221/41; 221/44; 221/49; 221/51; 221/53; 221/57; 221/63; 221/45; 221/303; 206/225

(58) Field of Classification Search
USPC ..... 221/45, 52, 46, 446, 33, 36, 39, 40, 41, 221/44, 49, 51, 53, 56, 57, 63, 303; 206/225
See application file for complete search history.

(56) References Cited

U.S. PATENT DOCUMENTS 1,072,859 A * 9/1913 Kingsley ..... 221/59
1,632,446 A * 6/1927 Krueger ..... 221/53

(Continued)

FOREIGN PATENT DOCUMENTS

CN 2004-80009135.9 5/2006
EP 2 243 410 10/2010

(Continued)

*Primary Examiner* — Rakesh Kumar
(74) *Attorney, Agent, or Firm* — Frommer Lawrence & Haug LLP

(57) ABSTRACT

Disclosed is a tissue paper supply case comprising a case body for containing tissue paper, a lid having a slot-like take-out hole for taking out the tissue paper therethrough, a platform member mounted within the case body for placing the tissue paper thereon, and means for energizing the platform member from the bottom of the case body toward the lid, wherein the lid is provided on its inner surface with a plurality of lid projections formed in parallel rows to the take-out hole on both sides of the take-out hole, which lid projections are tapered each having a protrusion height becoming larger with increasing distance from the take-out hole, and the platform member is provided on its upper surface with a plurality of platform projections formed in parallel rows to the take-out hole on both sides of the position facing the take-out hole, which platform projections are tapered each having a protrusion height becoming larger with increasing distance from the position facing the take-out hole and wherein the plurality of lid projections formed on the lid and the plurality of platform projections formed on the platform member are placed oppositely alternating with each other.

6 Claims, 8 Drawing Sheets

(56) References Cited

U.S. PATENT DOCUMENTS

| | | | | | |
|---|---|---|---|---|---|
| 2,027,671 | A | * | 1/1936 | Broeren | 221/59 |
| 2,082,765 | A | * | 6/1937 | Krueger | 221/45 |
| 2,253,742 | A | * | 8/1941 | West et al. | 221/52 |
| 2,872,067 | A | * | 2/1959 | Gessner et al. | 206/567 |
| 3,343,716 | A | | 9/1967 | Peebles | |
| 4,166,551 | A | * | 9/1979 | Stiros | 221/51 |
| 4,694,973 | A | * | 9/1987 | Rose et al. | 221/46 |
| 4,706,844 | A | | 11/1987 | Omdoll et al. | |
| 4,838,454 | A | * | 6/1989 | Salzmann et al. | 221/57 |
| 4,969,575 | A | * | 11/1990 | Kobayashi | 221/45 |
| 4,986,440 | A | * | 1/1991 | Windorski | 221/45 |
| 5,080,255 | A | * | 1/1992 | Windorski | 221/45 |
| 5,143,250 | A | * | 9/1992 | Freitag | 221/59 |
| 5,540,354 | A | * | 7/1996 | Annand | 221/52 |
| 6,378,726 | B1 | * | 4/2002 | Chan et al. | 221/51 |
| 6,514,585 | B1 | * | 2/2003 | Pearson et al. | 428/40.1 |
| 6,824,007 | B2 | * | 11/2004 | Timmers et al. | 221/53 |
| 7,048,143 | B2 | * | 5/2006 | Sanders et al. | 221/46 |
| 7,093,737 | B2 | * | 8/2006 | Tramontina et al. | 221/46 |
| 7,124,911 | B2 | * | 10/2006 | Tramontina et al. | 221/45 |
| 7,178,689 | B2 | * | 2/2007 | Wieser et al. | 221/52 |
| 7,568,593 | B2 | * | 8/2009 | Cittadino et al. | 221/59 |
| 7,648,045 | B2 | * | 1/2010 | Christensen et al. | 221/53 |
| 7,938,294 | B2 | * | 5/2011 | Cittadino et al. | 221/62 |
| 8,162,142 | B2 | | 4/2012 | Kobayashi | |
| 2003/0057221 | A1 | * | 3/2003 | Guillemette et al. | 221/45 |
| 2004/0206768 | A1 | | 10/2004 | Tramontina et al. | |
| 2005/0040177 | A1 | * | 2/2005 | Tramontina et al. | 221/56 |
| 2006/0027590 | A9 | | 2/2006 | Tramontina et al. | |
| 2010/0288666 | A1 | | 11/2010 | Kobayashi | |

FOREIGN PATENT DOCUMENTS

| | | | |
|---|---|---|---|
| EP | 2 243 410 | B1 | 10/2010 |
| JP | 63-58901 | | 4/1988 |
| JP | 06-046401 | | 11/1994 |
| JP | 2006-027694 | | 2/2006 |
| JP | 2006-523586 | | 10/2006 |
| JP | 2009-165763 | | 7/2009 |
| JP | WO 2009/090911 | A1 | 7/2009 |

* cited by examiner

TISSUE PAPER SUPPLY CASE

TECHNICAL FIELD

This invention relates to a supply case for tissue paper contained in a manner capable of sequentially taking out the tissue paper one by one.

BACKGROUND ART

As illustrated in FIG. 8, a stack of thin paper has been so far formed by stacking double-folded thin paper sheets one on top of the other with their folding directions reversing alternately to sequentially take out the thin paper one by one (hereinafter referred to as tissue paper). As an example of such tissue paper, there have been known hair perm paper used to hold the tip of hair in the state wrapped therewith in perming, tissue paper, paper towel and so on.

As examples of the hair perm paper, there are various tissue paper differing in size, such as narrow tissue paper commensurate with a slender rod for tiny hair curling, and wide tissue paper commensurate with a thick rod for thick hair curling.

As an example of a supply case for sequentially taking out tissue paper, Patent Literature 1 discloses a tissue paper supply case for containing tissue paper sheets in a state of energizing upward thereinside so as to take out the tissue paper sheets through a take-out hole open in the middle of the upper surface member of a rectangular case body, which is provided on the inside of the upper surface member with a chevron-shaped induction surface facing toward the take-out hole. As well, there is disclosed that the tissue paper of various sizes can be contained and taken out according to the size of the tissue paper by forming opposite grooves along the upper and lower insides of the case body and setting a partition plate into between the opposite grooves.

Also, Patent Literature 2 discloses a dispenser for sanitary tissue paper, which is provided on the inner sides of its both broad side surfaces with a position adjusting member made of compressible elastic material such as urethane foam.

PRIOR ART REFERENCES

Patent Literature

Patent Literature 1: Japanese Examined Utility Model Publication No. 6-46401

Patent Literature 2: Japanese Unexamined Patent Publication No. 2006-27694

SUMMARY OF THE INVENTION

Problems to be Solved by the Invention

The tissue paper supply case disclosed in Patent Literature 1 makes it possible to contain tissue paper according to the size by width-directional centering a partition plate matching each size of various tissue paper sheets to be stored into the inside of the case body. Therefore, the partition plate must be inserted into one of the grooves positioned corresponding to the size of the tissue paper to be stored on each occasion, consequently causing inconvenience such that the partition plate different from the supply case body has to be indispensably prepared and the work of inserting the partition plate requires much time and labor. Besides, the width of the tissue paper to be stored depends on the position of the groove, thereby inconveniently causing displacement between the tissue paper size and the position of the groove. As a result, there are cases where the partition plate cannot be used.

In the dispenser for sanitary tissue paper in Patent Literature 2, the position in which the tissue paper is fitted is adjusted by filling the inner space with the compressible elastic member so as to come into contact with the side surface of the boxed tissue paper. Therefore, in the case of a non-boxed tissue paper such as hair perm paper, the pressure of the elastic member is exerted directly on the tissue paper contained within the dispenser, consequently to inconveniently cause curvature or deformation of the tissue paper and a difficulty in taking out the tissue paper through a take-out hole.

In view of the aforementioned problems, it is an object of the present invention is to provide a tissue paper supply case capable of easily containing the tissue paper in the middle relative to a take-out hole in the case regardless of the size of the tissue paper without requiring any member other than the supply case body and sequentially taking out the tissue paper one by one regardless of the size of the tissue paper contained therein.

Means for Solving the Problems

In order to solve the above problems according to the present invention, there is provided a tissue paper supply case comprising a case body for containing tissue paper, a lid having a slot-like take-out hole for taking out the tissue paper therethrough, a platform member mounted within the case body for placing the tissue paper thereon, and means for energizing the platform member from the bottom of the case body toward the lid, wherein the lid is provided on its inner surface with a plurality of lid projections formed in parallel rows to the take-out hole on both sides of the take-out hole, which lid projections are tapered each having a protrusion height becoming larger with increasing distance from the take-out hole, and the platform member is provided on its upper surface with a plurality of platform projections formed in parallel rows to the take-out hole on both sides of the position facing the take-out hole, which platform projections are tapered each having a protrusion height becoming larger with increasing distance from the position facing the take-out hole and wherein the plurality of lid projections formed on the lid and the plurality of platform projections formed on the platform member are placed oppositely alternating with each other.

A stack of tissue paper sheets is placed on the platform member disposed within the case body and energized in the direction toward the lid to allow the tissue paper to be taken out through the take-out hole formed in the lid. In setting a stack of tissue paper sheets into the case body, the respective double-folded tissue papers are put on the platform member with their folding lines parallel to the take-out hole and forcibly held down by placing the lid on the case body to press the tissue paper sheets with the tapered platform projections formed on the platform member having a protrusion height becoming larger with increasing away from the take-out hole and the tapered lid projections formed on the lid having a protrusion height becoming larger with increasing away from the take-out hole. That is, the tissue paper sheets are firmly settled with the middle parts (width-directional center) of their folding lines on both sides facing the take-out hole with the guidance of the platform projections and the lid projections. Thus, even the tissue paper sheets of different sizes can be firmly retained with the width-directional center of the tissue paper sheets facing the take-out hole.

The tissue paper sheets are firmly retained with the width-directional center opposite to the take-out hole while causing the sheet edge of the tissue paper protrude from the take-out hole, so that the tissue paper sheets can be pulled out sequentially by picking up the sheet edges one by one. As the tissue paper sheets are taken out, the tissue paper sheets are curved in a space defined between the lower surface of the take-out hole and the uppermost sheet of the tissue paper due to the tapered lid projections formed on the inner surface of the lid. Due to the curve of the tissue paper sheets, following tissue paper sheets stacked in folds can easily be pulled out and the mound-like curved tissue paper sheets are prepared for succeeding operation of pulling out.

When the remaining sheets stored in the case body decrease, the plurality of lid projections formed on the lid and the plurality of platform projections formed on the platform member are united across each other on the outside of the tissue paper sheets in the width direction to adjust the width of the surface in contact with the tissue paper sheets on the platform member to a length comparable to the width of the tissue paper sheets contained in the case body. Thus, the space for allowing the tissue paper sheets to move on the platform member disappears to firmly hold the sheet edge in the width direction of the tissue paper sheets in the state depressed by the plurality of lid projections formed on the lid and the plurality of platform projections formed on the platform member. As a result, even when the remaining tissue paper sheets decrease, the tissue paper sheets are firmly retained with the width-directional center opposite to the take-out hole regardless of the width of the tissue paper, so that the tissue paper sheets can be sequentially taken out up to the last one.

The wording "width of the tissue paper sheet" depicted herein means the length in the folding direction of the tissue paper sheet, i.e. distance between the folding lines of the tissue paper sheets. The tissue paper used in this invention includes not merely a stack of tissue paper, but also a package of tissue paper bundled with wrapping sheet such as of film and a package of tissue paper bundled with wrapping sheet such as of film and further provided with a tab for pulling off a cutting break line formed in the wrapping sheet (cf. Japanese Unexamined Patent Publication No. 2009-165763).

The lid is preferably formed of two lid members independent of each other, which are opposed to each other to form the take-out hole. By placing a stack of tissue paper on the platform member and attaching one of the lid members to the case body while depressing the upper surface of the tissue paper with a finger or fingers in placing the tissue paper into the case body, the tissue paper can be temporarily settled on the platform member. Then, by attaching the other lid member to the case body upon picking out the sheet edge of the uppermost sheet of the tissue paper temporarily settled on the platform member through the take-out hole, the tissue paper can be settled within the case body.

It is preferable to arrange the plurality of lid projections formed on the lid and/or the plurality of platform projections formed on the platform member in a symmetrical state with respect to the center axis of the take-out hole. The tissue paper contained within the case body is evenly pressed down with the plurality of lid projections formed on the lid and/or the plurality of platform projections formed on the platform member, thereby to be settled stably.

The lid projections formed on the lid are a plurality of ribs which are preferably configured so as to be engaged in grooves defined between the platform projections formed on the platform member. As the plurality of lid projections formed on the lid are in the rib shape, the contact surface between the lid projections and the tissue paper is small to reduce friction caused therebetween, so that the tissue paper can be taken out smoothly from the take-out hole.

The plurality of lid projections formed on the lid and/or the plurality of platform projections formed on the platform member are preferably formed so as to increase in protrusion height in a linearly discontinuous manner. This arrangement makes the lid projections and/or the platform projections having a stepwise protrusion height coping with the width of the tissue paper, thus to suitably retain the tissue paper of a designated size.

The plurality of lid projections formed on the lid and/or the plurality of platform projections formed on the platform member are preferably formed so as to increase in protrusion height in a curvilinearly continuous manner. Such continuous increase in protrusion height on the lid projections and/or the platform projections makes it possible to cope with variation in width of the tissue paper, thus to properly retain the tissue paper of various sizes.

Effect of the Invention

The present invention provides a tissue paper supply case having excellent effects as described below.

(1) Tissue paper sheets of different sizes can be contained and securely settled in one supply case with the width-directional center facing the take-out hole, thereby to allow for stable and sequential taking out.

(2) Tissue paper sheets are securely settled in the supply case with the width-directional center opposite to the take-out hole even when the remaining sheets stored in the case body decrease, so that the tissue paper sheets can be sequentially taken out up to the last one.

(3) Supply case is easy to handle as in containing the tissue paper in the case body without requiring any member other than the supply case.

MODES FOR CARRYING OUT THE INVENTION

Figure 1:
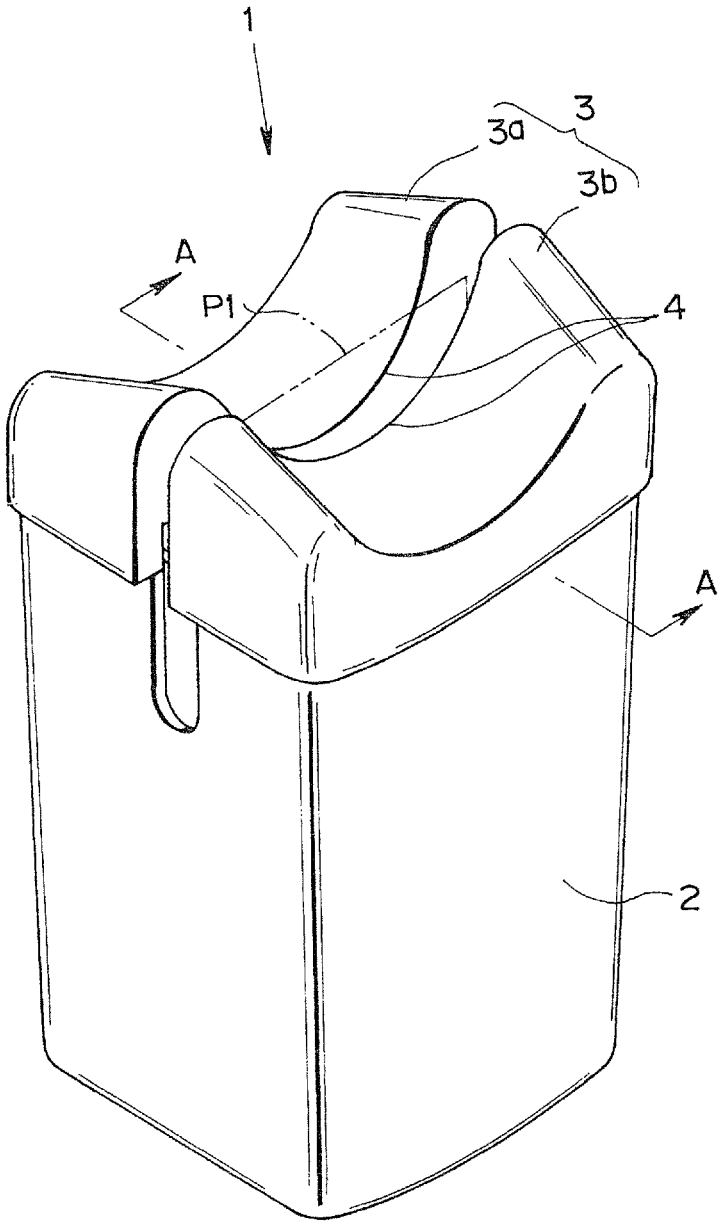
FIG. 1 is a perspective view of a tissue paper supply case in one embodiment of the present invention, as viewed from the outside of the case.

Embodiments of the present invention will be described hereinafter with reference to the accompanying drawings.

As illustrated in FIG. 1 through FIG. 7, a supply case 1 comprises a case body 2 for containing tissue paper P, a lid 3 having a slot-like take-out hole 4 for taking out the tissue paper P therethrough, a platform member 5 mounted within the case body 2 for placing the tissue paper P thereon, and energizing means 6 for the platform member 5 from the bottom of the case body 2 toward the lid 3, wherein the lid 3 is provided on its inner surface with a plurality of lid projections 30 formed in parallel rows to the take-out hole 4 on both sides opposite to the take-out hole 4, which each of lid projections 30 are tapered having a protrusion height becoming larger with increasing the distance from the take-out hole 4, and the platform member 5 is provided on its upper surface with a plurality of platform projections formed in parallel rows to the take-out hole 4 on both sides opposite to the take-out hole 4, which each of platform projections 50 are tapered having a protrusion height becoming larger with increasing the distance from the position opposite to the take-out hole and wherein the plurality of lid projections 30 formed on the lid 3 and the plurality of platform projections 50 formed on the platform member 5 are placed oppositely alternating with each other.

As illustrated in FIG. 1, the supply case 1 is mainly made of the case body 2 and lid 3. The lid 3 is formed of two lid members 3*a* and 3*b* independent of each other, which have a plane-symmetrical shape with respect to the center plane of a take-out hole 4 described below and divide the case body into two. In this embodiment, the lid members 3*a* and 3*b* are attached to the case body 2 with a prescribed distance to form the slot-like take-out hole 4 for taking out the tissue paper P therethrough. As illustrated in FIG. 3, the lid members 3*a* and 3*b* each have an attaching portion 31 on the side without the take-out hole 4, which is connected to an attaching portion 21 of the case body 2 by means of a formed wire spring, so that the lid members 3*a* and 3*b* can be open and close about the attaching portion
31 as illustrated in FIG. 2.

Figure 2:
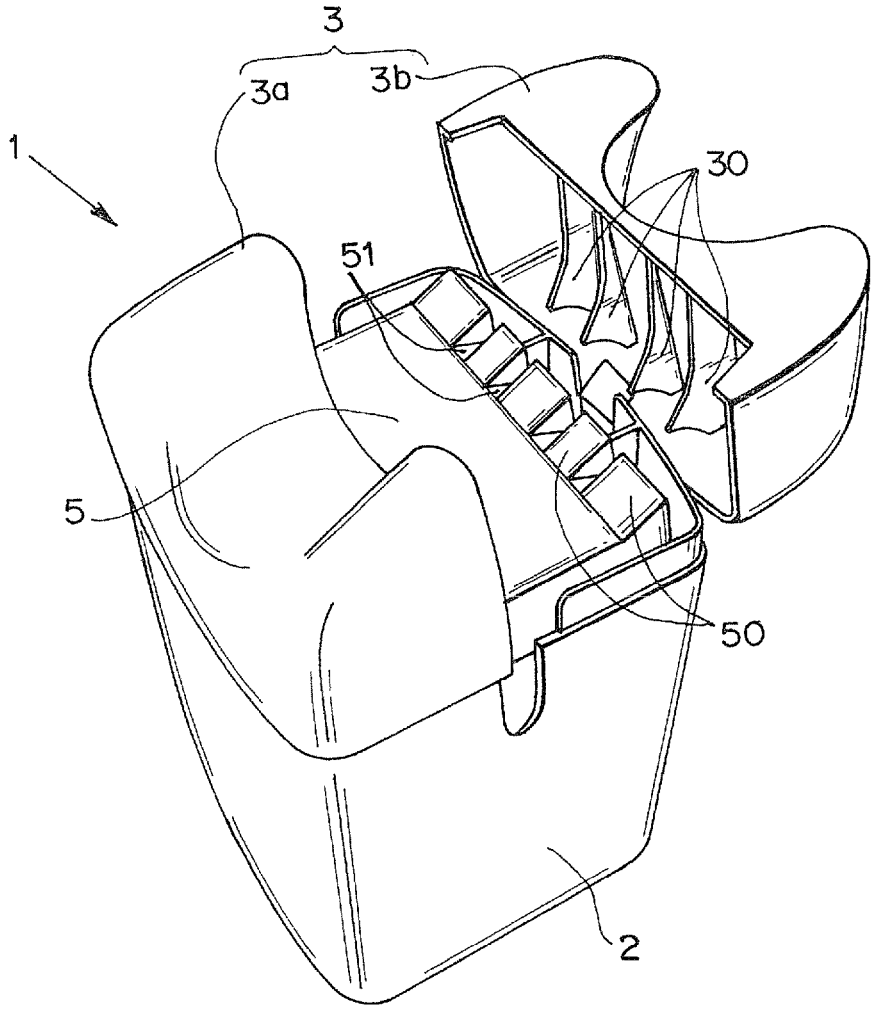
FIG. 2 is a view illustrating the state in which one of lid members constituting a lid of the tissue paper supply case in FIG. 1 is open.
Figure 3A:
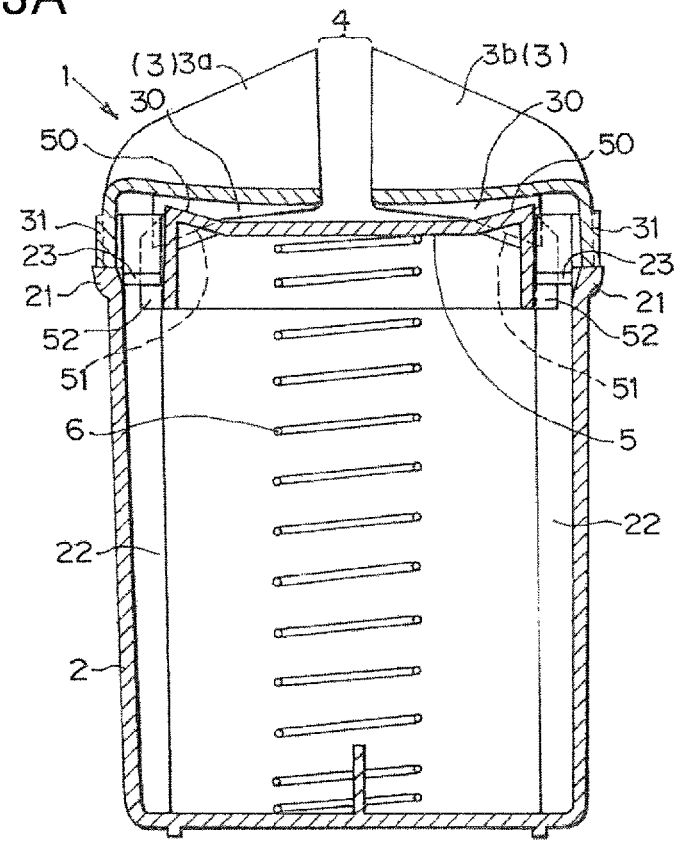
FIG. 3 is sectional views taken along line A-A in FIG. 1, wherein 3A illustrates the state in which a platform member is lifted by energizing means to the position nearest to the lid, and 3B illustrates the state in which the platform member is depressed to the bottom of the case body.
Figure 3B:
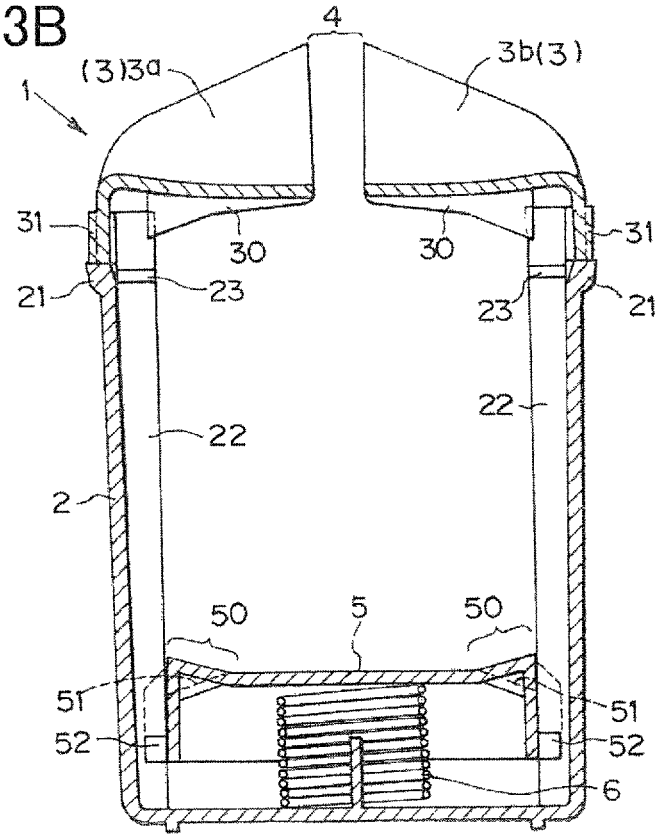

As illustrated in FIG. 2 and FIG. 3, the lid members 3*a* and 3*b* are provided on their inner surface with the plurality of tapered lid projections 30. The lid projections 30 attached to the case body 2 protrude toward the platform member 5 in their closed state. These lid projections 30 are formed in two rows parallel to the take-out hole 4 on both sides. The lid projections 30 in each row are not limited in number, but four projections are formed in this embodiment. These lid projections 30 have a plane-symmetrical shape with respect to the center plane that passes through the center of a take-out hole 4 described below and divides the case body 2 into two, and a protrusion height of each lid projections 30 toward the lid 3 increases in response to the distance from the take-out hole 4.

As illustrated in FIG. 3, the four lid projections 30 in each row are so designed that the lid projections 30 are made equal in vertical distance from one point of the respective lid projections 30 on a line parallel to the center axis of the take-out hole 4 to the upper surface of the platform member 5 in the closed state of the lid 3 attached to the case body 2. Consequently, the four lid projections 30 can uniformly depress the tissue paper P stacked on the platform member 5.

Figure 4A:
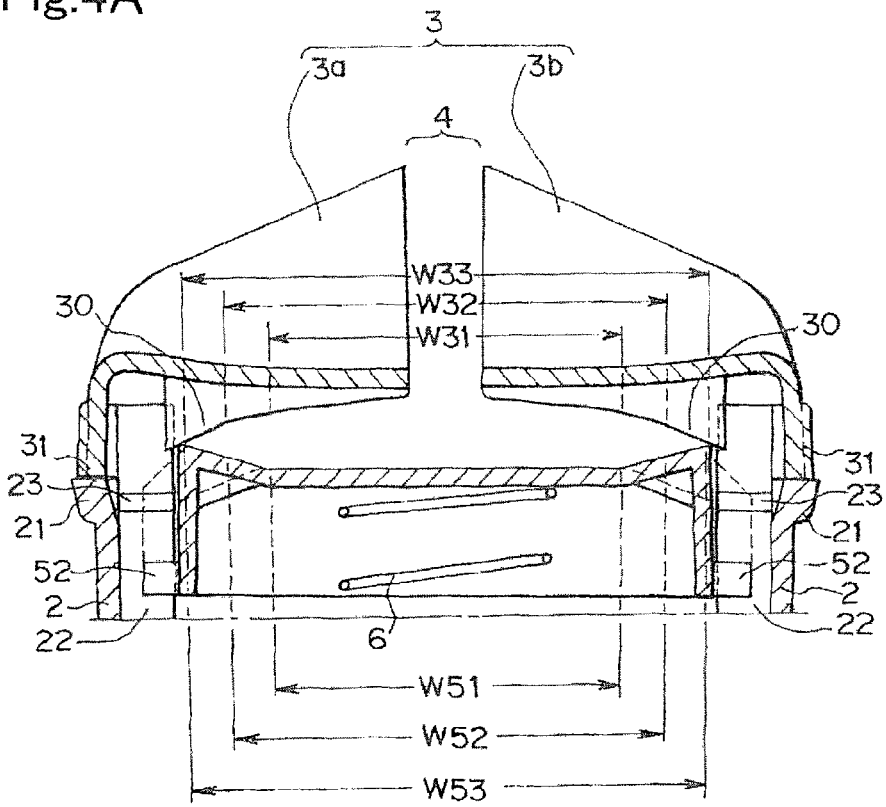
FIG. 4 is partially enlarged sectional views taken along line A-A in FIG. 1, wherein 4A illustrates the state in which the protrusion heights of the lid and platform member increase in a linearly discontinuous manner, and 4B illustrates the state in which the protrusion heights of the lid and platform member increase in a curvilinearly continuous manner.

The tapered lid projections 30 are provided on their leading ends with taper surfaces increasing in protrusion height in a linearly discontinuous manner, as illustrated in FIG. 4A. The number of taper steps is not specifically limited, but each lid projection 30 in this embodiment has three taper steps. Thus, the taper of each lid projection is formed in a stepwise fashion coping with the width WP of the tissue paper, so that the tissue paper P can stably be retained. To be more specific, the tissue paper P having the width substantially equal to the distance W31 from the first taper step of the lid projection 30 of the lid member 3*a* to the first taper step of the lid projection 30 of the lid member 3*b* is retained stably between the taper surfaces of the first taper steps of the lid projections 3*a* and 3*b*. Therefore, the multiple kinds of tissue paper having different widths can be settled stably due to the taper steps coping therewith. Meanwhile, the distance between the tapers of the lid members 3*a* and 3*b* need not necessarily be equal the distance between the tapers of the platform member 5 described below, but they are preferably substantially equal.

Figure 4B:
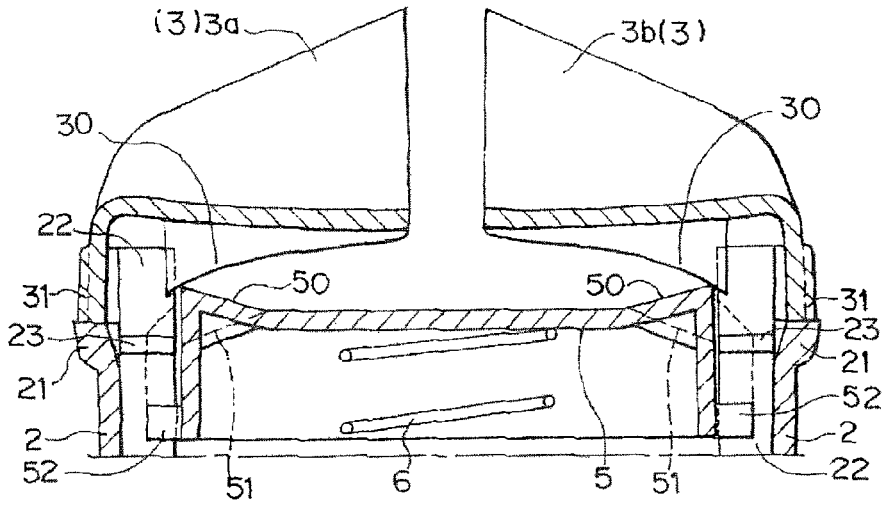

On the other hand, as illustrated in FIG. 4B, the tapered lid projections 30 may each have a single taper surface formed on the respective leading ends thereof, which increases in protrusion height in a curvilinearly continuous manner. This embodiment makes it possible to deal with the tissue paper P of more different sizes than that in FIG. 4A and firmly retain the tissue paper P.

Next, the platform member 5 will be described. As illustrated in FIG. 2 to FIG. 4, the platform member 5 is placed within the case body 2. When using the supply case, the tissue paper P is stacked on the upper surface of the platform member 5. Underneath the platform member 5, energizing means 6 is mounted for urging the platform member 5 from the bottom of the case body 2 toward the lid 3. The energizing means 6 is formed specifically of an elastic member such as, but not limited to, a coil spring, for instance. In this embodiment, the coil spring 6 is mounted between the bottom of the case body 2 and the lower surface of the platform member 5. As illustrated in FIG. 3, the platform member 5 is provided on its both ends with guide pieces 52 so as to attach the platform member 5 to the case body 2 by engaging the guide pieces 52 with guide rails 22. The platform member 5 is movable between the bottom of the case body 2 and the lid 3 with the guide pieces 52 guided by the guide rails 22 while being constantly urged upward by the spring 6 mounted therebeneath until being stopped by stoppers 23 of the guide rails 22.

As illustrated in FIG. 2 to FIG. 4, the platform member 5 is provided on it upper surface with the plurality of tapered platform projections 50. The platform projections 50 attached to the case body 2 protrude toward the lid 3 in their closed state. These platform projections 50 are formed in two rows parallel to the take-out hole 4 on both sides opposite to the take-out hole 4. The platform projections 50 in each row are not limited in number, but five projections are formed in this embodiment. These platform projections 50 have a plane-symmetrical shape with respect to the center plane that passes through the center of take-out hole 4 and divides the case body 2 into two, and a protrusion height of each platform projection 50 toward the lid 3 increases in response to the distance from the take-out hole 4.

As illustrated in FIG. 3, the five platform projections 50 in each row are so designed that the platform projections 50 are made equal in projection height of the respective platform projections 50 on a line parallel to the center axis of the take-out hole 4. Consequently, the five platform projections 50 can uniformly support the tissue paper P stacked on the platform member 5.

The tapered platform projections 50 are provided on their leading ends with taper surfaces increasing in protrusion height in a linearly discontinuous manner, as shown in FIG. 4A. The number of taper steps is not specifically limited, but each platform projection 50 in this embodiment has three taper steps. Thus, the taper of each platform projection is formed in a stepwise fashion coping with the width WP of the tissue paper, so that the tissue paper P can stably be held. To be more specific, the tissue paper P having the width substantially equal to the distance W51 between the first taper steps of the platform member 5 is stably held between the first taper steps of the platform member 5. Therefore, the multiple kinds of tissue paper having different widths can be held stably due to the taper steps coping therewith. Meanwhile, the distance between the tapers of the platform member 5 need not necessarily be equal the distance between the tapers of the lid members 3*a* and 3*b*, but they are preferably substantially equal. In this embodiment, the upper surface of the platform member 5 in a region other than the platform projection 50 and the grooves 51 is formed as a horizontal plane, but that may be formed as a non-perpendicular plane with respect to the center plane that passes through the center of take-out hole 4 and divides the case body 2 into two.

On the other hand, as illustrated in FIG. 4B, the tapered platform projections 50 may each have a single taper surface formed on the respective leading ends thereof, which increases in protrusion height in a curvilinearly continuous manner. This embodiment makes it possible to deal with the tissue paper P of more different sizes than that in FIG. 4A and firmly hold the tissue paper P.

The tapered lid projections 30 farmed on the lid 3 and the tapered platform projections 50 formed on the platform member 5 may be formed by combining the configuration having the protrusion heights increasing in a linearly discontinuous manner as illustrated in FIG. 4A and the configuration having the protrusion heights increasing in a curvilinearly continuous manner as illustrated in FIG. 4B.

Next, the relation in arrangement between the lid projections 30 formed on the lid 3 and the platform projections 50 formed on the platform member 5 will be described. As illustrated in FIG. 2, the lid projections 30 formed on the lid 3 and the platform projections 50 formed on the platform member 5 are placed oppositely alternating with each other. In this embodiment, the lid projections 30 formed on the inner surfaces of the lid members 3*a* and 3*b* constituting the lid 3 are four ribs. The four ribs are engaged in four grooves 51 defined between the five platform projections 50 of different size formed on the platform member 5. The grooves 51 correspond to the lid projections 30 formed on the lid 3 in position and projection height and are formed in a symmetrical state with respect to the center axis of the take-out hole, having a depth becoming larger away from the position opposite to the take-out hole 4.

In setting the tissue paper P into the supply case 1, the tissue paper P put on the platform member 5 is guided by the tapered platform projections 50 formed on the upper surface of the platform member 5 to be placed in the middle with the width-directional center facing the take-out hole 4. Then, by closing the lid 3, the tissue paper P is placed at the middle with the width-directional center facing the take-out hole 4 while being guided by the tapered lid projections 30 formed on the inner surface of the lid 3 as well. Furthermore, the tapered lid projections 30 depress the edges P2 in the width direction of the tissue paper from the lid 3 toward the bottom of the case body 2 with the taper steps or the protrusion height parts corresponding to the width WP of the tissue paper, thereby to settle the tissue paper. So, the tissue paper P, even when being different in size, can be firmly settled at the middle with respect to the take-out hole 4.

Figure 5:
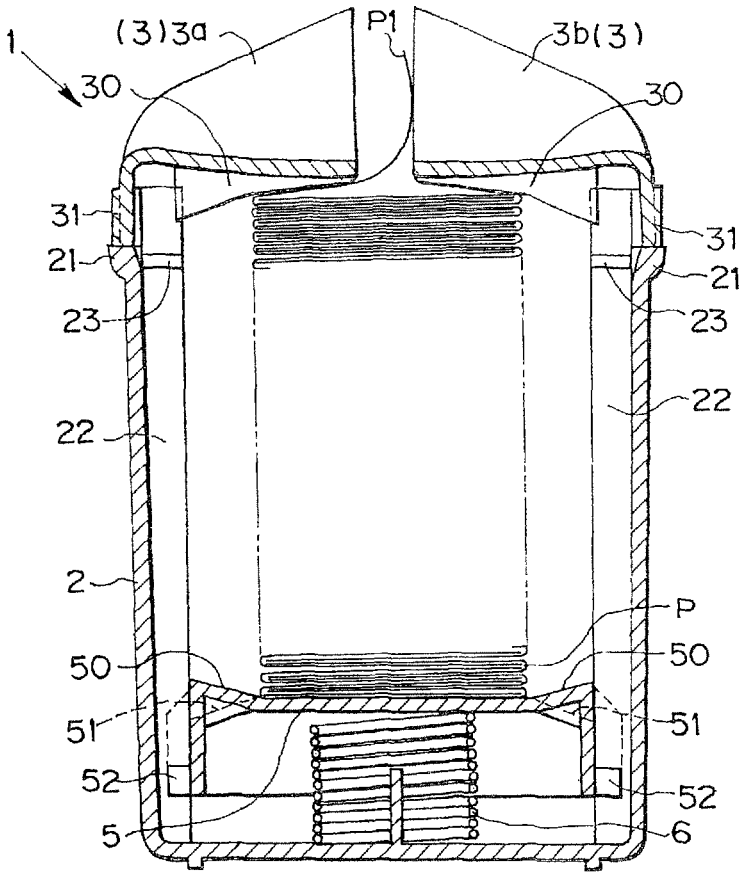
FIG. 5 is an explanatory view illustrating the use of narrow tissue paper.

An instance in which tissue paper having a narrow width is used in this embodiment will be described with reference to FIG. 5. The narrow tissue paper P' stacked on the upper surface of the platform member 5 is guided by the tapered platform projections 50 formed on the upper surface of the platform member 5, thereby to place the tissue paper P' in the middle with the width-directional center facing the take-out hole 4. At this moment, by closing the lid 3 while slightly pushing down the tissue paper with fingers, the tissue paper P' is placed at the middle with the width-directional center opposite to the take-out hole 4 while being guided by the tapered lid projections 30 formed on the inner surface of the lid 3. At that time, the tapered lid projections 30 depress the edges P2 in the width direction of the tissue paper with the taper steps or the protrusion height parts corresponding to the width WP' of the tissue paper, thereby to settle the tissue paper P'. The narrow tissue paper P' can be firmly settled at the middle facing the take-out hole 4 in such a state that the pullout edge P1' of the tissue paper protrudes from the take-out hole 4 without causing a disadvantage such that the pull-out edge P1' of the tissue paper protrudes just a little or does not protrude at all from the take-out hole 4 because the width-directional center of the tissue paper P' is placed apart from the take-out hole 4.

Figure 6:
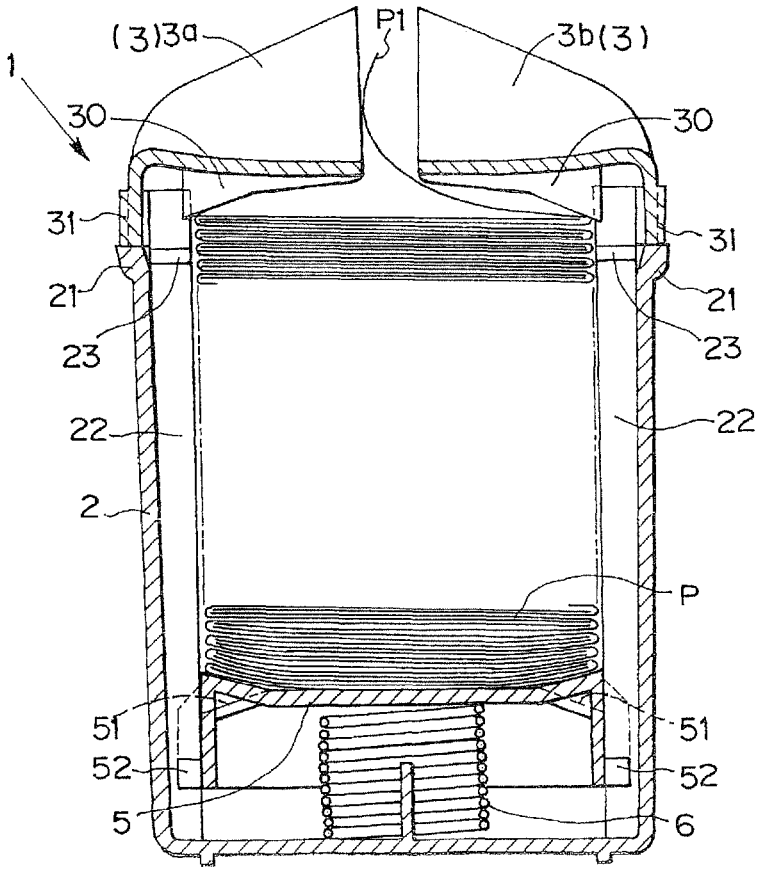
FIG. 6 is an explanatory view illustrating the use of wide tissue paper.

An instance in which tissue paper having a wide width is used in this embodiment will be described with reference to FIG. 6. The wide tissue paper P" stacked on the upper surface of the platform member 5 is placed on the entire upper surface of the platform member 5 similarly to a common supply case. Then, by closing the lid 3 while slightly pushing down the tissue paper P" with fingers, the tissue paper P" is depressed from the lid 3 toward the bottom of the case body 2 while bringing the sheet edges P2" in the width direction of the tissue paper into contact with the tapered lid projections 30, consequently to be settled in position.

Figure 7:
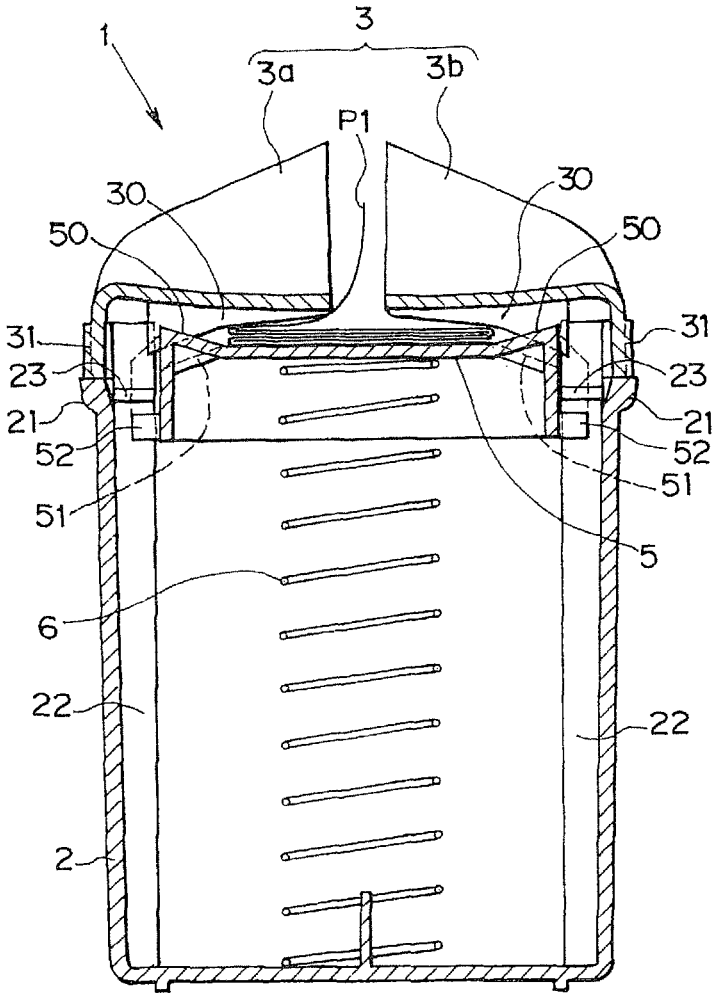
FIG. 7 is an explanatory view illustrating the state in which the remaining sheets stored in the case body decrease.
Figure 8:
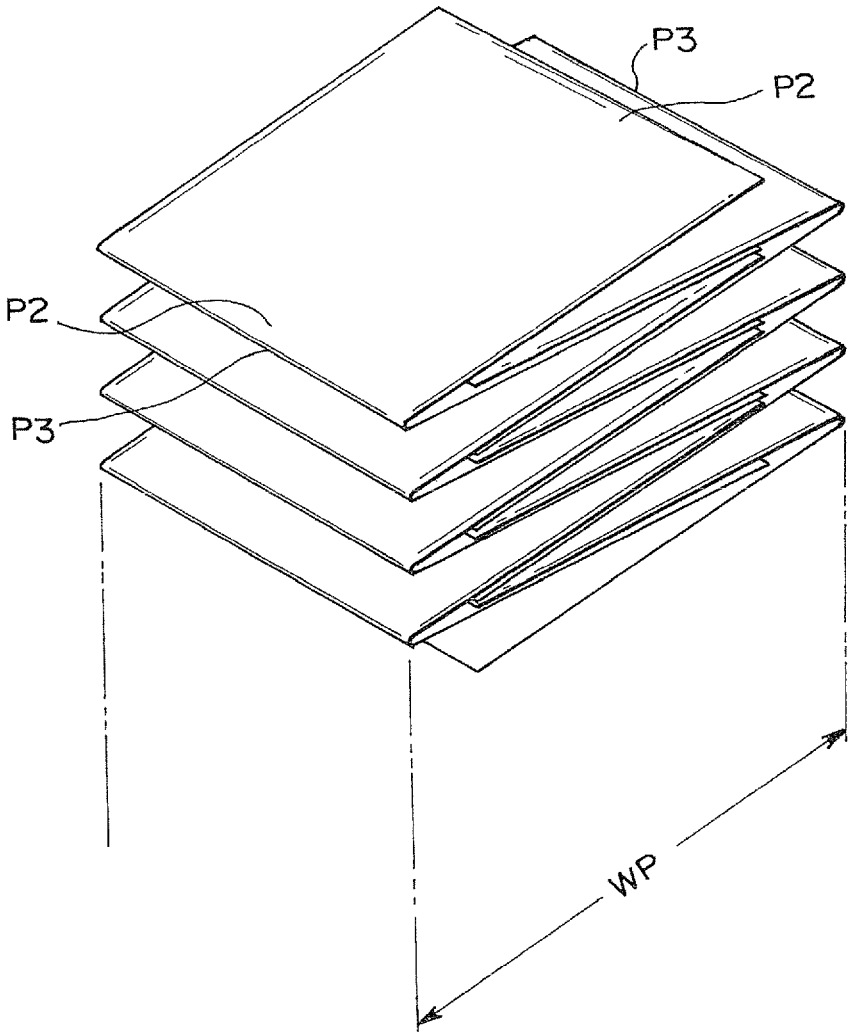
FIG. 8 is a perspective view illustrating the state of stacking the tissue paper sheets.

Next, an instance in which the remaining tissue paper decreases in this embodiment will be described with reference to FIG. 7. When the remaining tissue paper P stored in the case body 2 decreases, the lid projections 30 formed on the lid 3 are respectively engaged in the grooves 51 defined between the platform projections 50 formed on the platform member 5 on the outer side of the sheet edge P2 in the width direction of the tissue paper, thereby to adjust the width of the surface in contact with the tissue paper sheets on the platform member to a length comparable to the width WP of the tissue paper sheets contained in the case body. The lid projections 30 and platform projections 50 are united across each other on the outside of the sheet edge P2 of the tissue paper in the width direction to lose the space for allowing the tissue paper sheets to move on the platform member, consequently to settle the tissue paper P with the guide of the tapered platform projections 50 formed on the upper surface of the platform member 5. Therefore, even when the remaining tissue paper decreases, the tissue paper is retained in position in the middle with the width-directional center facing the take-out hole regardless of the width WP of the tissue paper, so that the tissue paper P can be sequentially taken out up to the last one.

Even though the invention is not limited to the representative embodiments described above, various changes, modifications and alterations in the teachings of the present invention may be contemplated by those skilled in the art without departing from the intended spirit and scope thereof.

INDUSTRIAL APPLICABILITY

The tissue paper supply case according to the present invention is capable of being used in not merely a beauty salon and barber shop but also a school, hospital, welfare facilities, ordinary household and the like and applied to hair peen paper used to hold the tip of hair in the state wrapped therewith in perming, tissue paper, paper towel and so on.

EXPLANATION OF REFERENCES LETTERS OR NUMERALS

1 Supply case
2 Case body

21 Attaching portion
22 Guide rail
23 Stopper
3 Lid
3*a* and 3*b* Lid member
30 Lid projection
W31, W32 and W33 Distance between the tapers of the lid projections of lid member 3*a* and 3*b*
31 Attaching portion
4 Take-out hole
5 Platform member
50 Platform projection
W51, W52 and W53 Distance between the tapers of the platform projections
51 Platform groove
52 Guide piece
6 Energizing means (coil spring)
P, P' and P" Tissue paper
P1 and P1' Pullout edges
P2, P2' and P2" Sheet edge in the width direction
P3 Folding line
WP and WP' Width of tissue paper

What is claimed is:

1. A tissue paper supply case comprising:

a case body for containing tissue paper, a lid having a slot-like take-out hole for taking out said tissue paper therethrough, a platform member mounted within said case body for placing said tissue paper on an upper surface thereof, and elastic member energizing said platform member from a bottom of said case body toward said lid, said tissue paper is set between the upper surface of the platform member and an inner surface of said lid, wherein said lid is provided on the inner surface with a plurality of lid projections formed in parallel rows to said take-out hole on both sides of said take-out hole, said lid projections being tapered and protruding toward said platform member in a closed state of said lid, each having a protrusion height becoming larger with increasing distance from said take-out hole, and said platform member is provided on the upper surface with a plurality of platform projections formed in parallel rows to said take-out hole on both sides of a position facing said take-out hole, said platform projections being tapered and protruding toward said lid in the closed state of said lid, each having a protrusion height becoming larger with increasing distance from the position facing said take-out hole and wherein said plurality of lid projections formed on said lid and said plurality of platform projections formed on said platform member are placed oppositely alternating with each other.

2. The tissue paper supply case set forth in claim 1, wherein said lid is formed of two lid members independent of each other, said lid members being opposed to each other to form said take-out hole.

3. The tissue paper supply case set forth in claim 1, wherein said plurality of lid projections formed on said lid and/or said plurality of platform projections formed on said platform member are arranged in a symmetrical state with respect to a center axis of said take-out hole.

4. The tissue paper supply case set forth in claim 1, wherein said lid projections formed on said lid are a plurality of ribs engaged in grooves defined between said platform projections formed on said platform member.

5. The tissue paper supply case set forth in claim 1, wherein said plurality of lid projections formed on said lid and/or said plurality of platform projections formed on said platform member are formed to increase in protrusion height in a linearly discontinuous manner.

6. The tissue paper supply case set forth in claim 1, wherein said plurality of lid projections formed on said lid are formed to increase in protrusion height in a curvilinearly continuous manner and said plurality of platform projections formed on said platform member are formed to increase in protrusion height in a continuous manner.

* * * * *